United States Patent [19]

Gottlieb

[11] Patent Number: 4,485,606

[45] Date of Patent: Dec. 4, 1984

[54] TRUSS STRUCTURES CONSTRUCTED WITH METAL WEB MEMBERS

[75] Inventor: Robert Gottlieb, Miami, Fla.

[73] Assignee: Gang-Nail Systems, Inc., Miami, Fla.

[21] Appl. No.: 337,671

[22] Filed: Jan. 7, 1982

[51] Int. Cl.[3] ..... E04C 3/292

[52] U.S. Cl. ..... 52/694; 52/693; 52/696

[58] Field of Search ..... 52/693–696, 52/634–636

[56] References Cited

U.S. PATENT DOCUMENTS

| | | | |
|---|---|---|---|
| 1,656,741 | 1/1928 | Lane | 52/695 |
| 1,799,337 | 4/1931 | Warhus | 52/634 |
| 1,880,478 | 10/1932 | Ragsdale | 52/694 |
| 1,880,480 | 10/1932 | Ragsdale | 52/694 X |
| 2,846,760 | 8/1958 | Rohn | 52/696 X |
| 3,103,262 | 9/1963 | Handley . | |
| 3,882,653 | 5/1975 | Ollman | 52/694 |
| 4,040,232 | 8/1977 | Snow et al. | 52/693 X |
| 4,078,352 | 3/1978 | Knowles | 52/693 |
| 4,241,557 | 12/1980 | Jensen | 52/693 X |
| 4,291,515 | 9/1981 | Harding . | |
| 4,295,318 | 10/1981 | Perlman | 52/693 |
| 4,348,850 | 9/1982 | Reeder et al. | 52/693 |

FOREIGN PATENT DOCUMENTS

| | | | |
|---|---|---|---|
| 1230644 | 4/1960 | France | 52/693 |
| 126875 | of 1918 | United Kingdom | 52/691 |

*Primary Examiner*—Alfred C. Perham

*Attorney, Agent, or Firm*—LeBlanc, Nolan, Shur & Nies

[57] ABSTRACT

A plurality of V-shaped metal web members serve to interconnect two elongated wooden members for forming a truss or joist assembly. The two elongated wooden members are arranged so as to extend parallel to each other with a spacing therebetween. The metal web members are placed in the spacing between the wooden members and have their extremities connected to the wooden members. Each of the metal web members has connector nail plates located both at its apex and at each of its extremities. Struck out from each connector plate are a plurality of pairs of teeth with each pair of teeth leaving a corresponding slot between them. All of the teeth extend from the same face of the metal web member. Each of the connector plates at the two extremities is connected to the apex connector plate by a leg member. Each of the legs has at least one groove which extends from the same side of the metal web member as the teeth. Each of the legs also has side flanges extending on both sides thereof for the entire length of the leg which flanges also extend in the same direction as the groove. The flanges and grooves are formed with appropriate depths to sufficiently increase the rigidity of the metal web member for avoiding any bending of the legs when subjected to normal compressive loads.

18 Claims, 9 Drawing Figures

58
60
57
55
34
36
16

52
26
36
32
34

22
84
90
26
92
88
80
82
86
24

78
74
76

66
62
64

72
68
70

TRUSS STRUCTURES CONSTRUCTED WITH METAL WEB MEMBERS

BACKGROUND OF THE INVENTION

The present invention relates to wooden structures and metal connectors for joining wooden members to form the wooden structures such as in the construction of wooden joists for enabling such wooden structures to be used to support structural loads.

In constructing various types of wooden truss assemblies, including both certain types of roof trusses and floor joists, it has been common to use large wooden structural members, e.g. wooden members having a width of at least 10 inches. Such large wooden members, however, are becoming increasingly difficult to find and as a result have tremendously increased in cost. Consequently various alternatives have been sought for enabling the construction of such trusses employing more commonly available wooden members such as 2 by 4 wooden strips. In seeking to find such alternatives there have been two primary criteria that had to be met. First, the alternative devices had to be able to withstand large compressive loads so that the trusses that were constructed could be used for bearing substantial structural loads. Secondly, it was considered desirable to develop alternative devices that could be prefabricated at a manufacturing plant and then easily shipped to a building site without a high degree of risk of incurring damage to the truss structures.

Three types of devices that have been developed for prefabricating such structural trusses are illustrated in U.S. Pat. Nos.: 3,025,577 to Jureit; 3,298,151 to Jureit and 4,078,352 to Knowles. Each of these patents illustrates a metal web member stamped out from a piece of sheet metal with the web member having at least one leg with connector plates at both of the extremities of such leg.

The two patents to Jureit both illustrate metal web members having a single leg with connector plates at both extremities of the leg. Each of the connector plates has a plurality of teeth that are stamped out from the plate which teeth are then embedded in the wooden members that are to be interconnected by the web member.

The patent to Knowles discloses a V-shaped metal web member having connector plates both at its apex and at the extremity of the two legs of the V-shaped member. Each of the legs has extending along substantially its entire length a rib that extends outwardly from the leg and side flanges extending in the opposite direction as the rib. Each of the connector plates in this web member has a plurality of teeth that are struck out from the plate with these teeth extending in a direction opposite the direction in which the rib along each leg extends. The web members disclosed by this patent to Knowles are used in prefabricating truss assemblies at a manufacturing plant with such assemblies then being shipped to a building site. Due to the existence of the projecting ribs, the truss assemblies along their lateral sides are not entirely flat which leads to problems when shipping such assemblies. The existence of the ribs that project outwardly from the truss assemblies creates two undesirable problems. First, the projecting ribs limit the number of trusses that can be packed in the transporting vehicle. The projecting ribs also have a tendency during shipping to bang against the adjacent truss assemblies thereby often causing damage to such assemblies.

While such problems have existed, in accordance with the teachings of the patent to Knowles it has been believed that it was mandatory to incorporate such ribs extending in the opposite direction as the teeth and the flanges as disclosed by such patent in order to provide sufficient compressive strength to the legs of the V-shaped web member.

SUMMARY OF THE INVENTION

An object of the present invention is to provide an improved metal web member for use in prefabricating truss assemblies capable of bearing substantial structural loads.

Another object of the present invention is to provide an improved V-shaped metal web member capable of withstanding substantial compressive loads for interconnecting elongated wooden members in the construction of joist assemblies.

A further object of the present invention is to provide V-shaped metal web members that can be used in connecting elongated wooden strips so as to form truss assemblies presenting substantially flat lateral side faces.

Still another object of the present invention is to provide a V-shaped metal web member having at least one groove extending along each leg of such member with such groove extending in the same direction as teeth that are struck out from connector plates located both at the apex of the member and at each of its extremities.

A still further object of the present invention is to provide a V-shaped metal web member with each leg of the member having a groove extending along its length and flanges along each of its sides with the groove being deeper at its ends than at the center and the side flanges being longer at their centers than at their ends.

A still further object of the present invention is to provide a wooden truss assembly formed of at least two elongated wooden members spaced apart and interconnected by a plurality of improved V-shaped metal web members.

These objectives are accomplished by the utilization of the V-shaped metal web member constructed in accordance with the present invention. The metal web member has connector plates located both at its apex and at each of its extremities. Each connector plate has struck out therefrom a plurality of pairs of teeth. A leg member connects each of the connector plates at each extremity with the connector plate at its apex. Each leg member has at least one groove that extends along the length of the leg member. This groove extends from the same side of the metal web member as the teeth that are struck out from the connector plates. Each of the legs has side flanges extending on both sides of the leg for the entire length of the leg. These side flanges of the leg also extend in the same direction as the groove and the teeth struck out from the connector plates. The flanges and the groove of the leg are formed with appropriate depths to sufficiently increase the rigidity of the metal web member for avoiding any bending of the leg when subjected to normal compressive loads.

The groove that is formed within each leg can be a single groove that extends along substantially the entire length of the leg. The groove within each leg is deeper at its ends than at its center. In a converse manner the flanges projecting from the sides of the legs are deeper at the center than at the ends. The provision of the deeper flanges at the center of each leg increases the rigidity of the leg for enabling such leg to withstand greater compressive loads. Alternatively, instead of a single groove extending the entire length of the leg, two small grooves can be used with one groove being arranged at each of the ends of the legs. With this alternative embodiment, the extra metal that is not taken up in forming the groove then can be used for forming deeper flanges in the central portion of the leg. In both embodiments, however, the width of each leg remains substantially constant throughout its length. In another alternative embodiment, each leg can have two parallel longitudinally extending grooves.

Normally the flanges extending along the sides of each leg are flat. If the leg is to be subjected to extremely high compressive loads, however, the flanges can be curved so as to take on an approximately tubular shape. Such a tubular formation of the flanges provides an even greater ability for the legs to withstand compressive loads.

The depth of each of the flanges is approximately $\frac{1}{3}$ of the width of the corresponding leg. In accordance with one preferred embodiment of the web member the width of the leg is approximately $1\frac{1}{4}$ inches and the depth of each of the flanges is approximately 19/32 inch. The variance in the depth of each of the flanges between the deeper center section and the ends is approximately 1/16 inch.

The width at the widest portion of the connector plate located at the apex of the metal web member is slightly less than twice the width at the widest portion of each of the connector plates located at the extremities of the metal web member. In accordance with one preferred embodiment of the metal web member, the outer top edge of the connector plate at the apex is approximately 6 inches and the outer bottom edge of each of the connector plates at the extremities is approximately $3\frac{3}{4}$ inches.

The pairs of teeth struck out from each of the connector plates can be of the type disclosed in commonly assigned U.S. patent application Ser. No. 71,551 to Moyer et al. filed Aug. 30, 1979. The subject matter of such application is hereby incorporated by reference.

DESCRIPTION OF THE PREFERRED EMBODIMENTS

Figures 1, 2, 3:
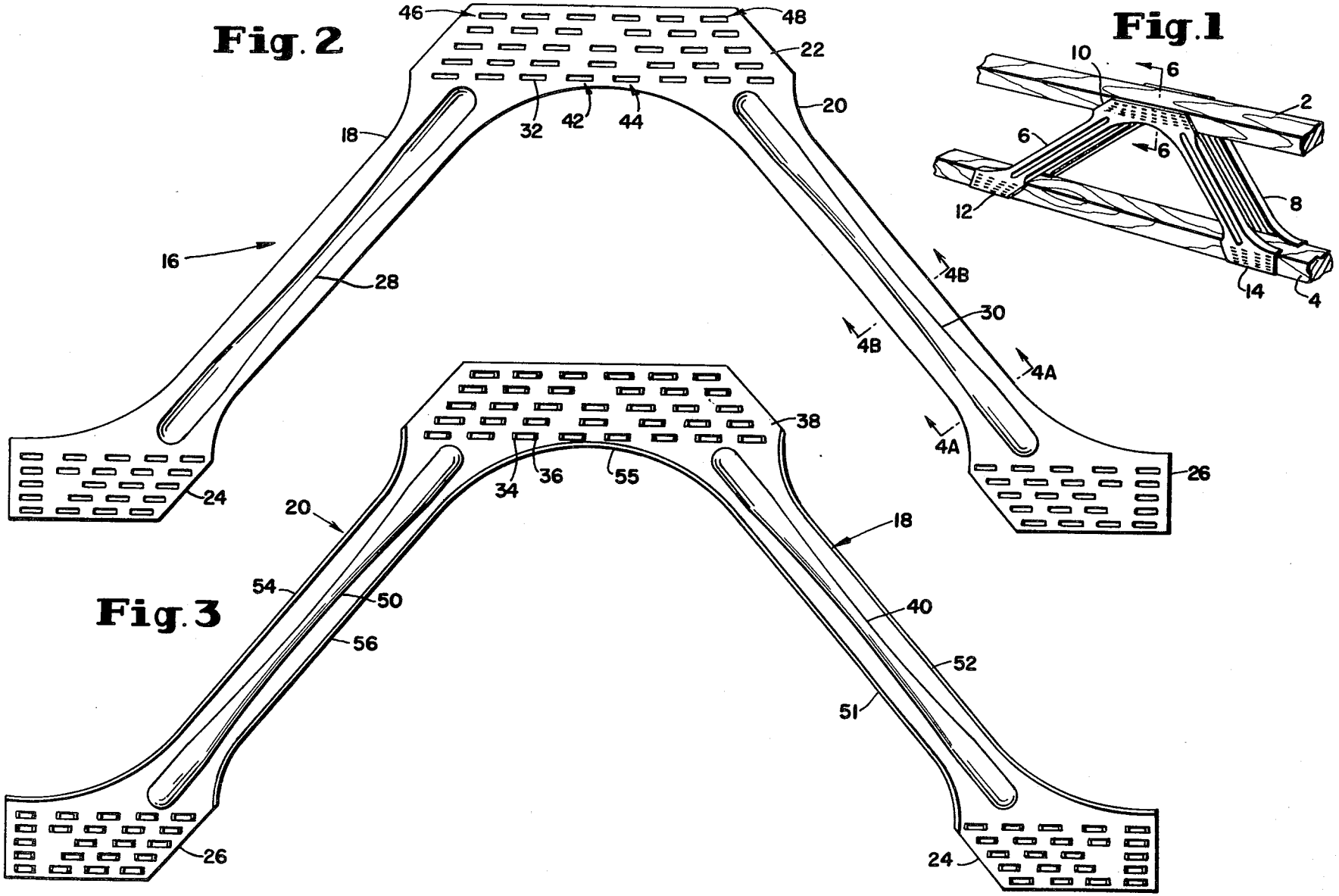
FIG. 1 is a perspective view of a portion of a joist structure constructed in accordance with the present invention.
FIG. 2 is a front plan view of a V-shaped metal web member constructed in accordance with the present invention.
FIG. 3 is a rear plan view of the metal web member illustrated in FIG. 2.

Two elongated wooden members, 2 and 4, which are spaced apart and extend in substantially parallel directions are interconnected by a plurality of metal web members such as members 6 and 8, as shown in FIG. 1. Each of the metal web members has a connector plate 10 at its apex and connector plates 12 and 14 at its two extremities. A series of these metal web members are arranged on each side of the two wooden members with the members normally being arranged so that the extremities are approximately adjacent each other. The number of web members arranged on each side of the wooden members depends both on the length of the wooden members and the compressive loads to which such members will be subjected.

Each metal web member 16 has two legs 18 and 20 with each leg interconnecting apex connector 22 with one of the connector plates at the two extremities, 24 and 26. Extending along each of the two legs are grooves, which grooves extend in the same direction as the teeth that are punched out from the connector plates of the metal web member. Each of the grooves, 28 and 30, is deeper and wider at the two ends than at the center of the groove. Thus each groove has a narrowed portion, such as portions 40 and 50 as shown in FIGS. 2 and 3.

Each of the connector plates has a plurality of pairs of teeth such as teeth 34 and 36. Teeth 34 and 36 when struck out leave a slot therebetween such as slot 32. The teeth in the connector at the apex are arranged with centrally arranged teeth such as teeth 42 and 44 and additional rows of teeth, such as rows 46 and 48, extending in a slanted direction, in the same general direction as the adjacent legs 18 and 20, respectively.

As shown in FIG. 3, the grooves form protractions that extend outwardly from rear face 38 of the metal web member. Extending along the sides of each of the legs are flanges. Two flanges 54 and 56 extend along the sides of leg 18 in the same direction as the teeth struck out from the connector plate as well as in the same direction as groove 28. Similarly flanges 51 and 52 extend outwardly along the sides of leg 20.

Figures 4A, 4B, 4C, 5, 6, 7:
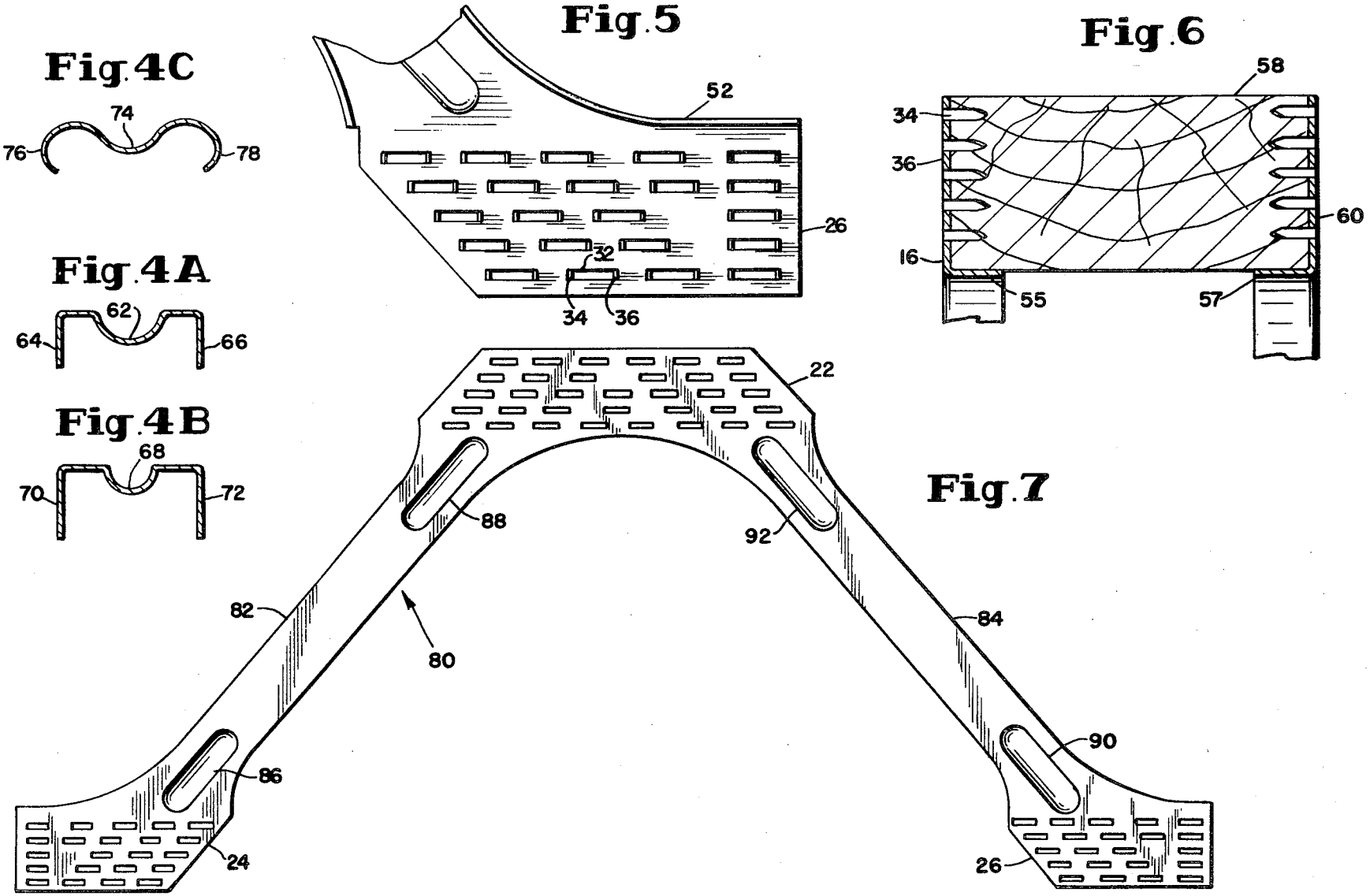
FIG. 4A is a sectional view through one of the legs of the metal web member shown in FIG. 2 taken along lines 4A—4A.
FIG. 4B is a cross-sectional view through one of the legs of the metal web member shown in FIG. 2 taken along lines 4B—4B.
FIG. 4C is a sectional view through one of the legs of a modified embodiment of a metal web member in accordance with the present invention.
FIG. 5 is an enlarged view of the rear face of a connector plate at one of the extremities of the metal web member illustrated in FIG. 3.
FIG. 6 is an enlarged sectional view along lines 6—6 of FIG. 1.
FIG. 7 is a front plan view of another modified embodiment of a metal web member constructed in accordance with the present invention.

In the metal web member 16 shown in FIGS. 2 and 3, the groove is more narrow at the center and the flanges are longer at the center than at the ends of the leg, as can be seen from FIGS. 4A and 4B. As shown in FIG. 4A which is a cross section taken along lines 4A—4A there is a groove 62 with outer flanges 64 and 66. At the center of leg 20, however, the groove becomes more narrow and not as deep as shown by groove 68 in FIG. 4B. At the same time the flanges 70 and 72, as shown in FIG. 4B, are longer. There is a gradual transition both in the size of the groove and the size of the two flanges along the length of the leg with the size of the groove and the size of the flanges being substantially the same at the two ends but different in the center.

As shown in FIGS. 4A and 4B, the side flanges are flat. In an alternative embodiment, however, as shown in FIG. 4C both of the side flanges 76 and 78 can be provided with a tubular shape with both tubes extending outwardly from groove 74. Such a tubular shape for the flanges would provide the leg with an even greater ability to remain rigid and avoid bending under high compressive loads.

The flange that extends along the outer side of each leg such as shown by flange 52 in FIG. 5 continues along a path along the top of connector plate 26. This extended portion of the flange 52 and the corresponding portion of flange 54 on the other leg of the web member serves to position the web member on the wooden strips such as strip 4 as shown in FIG. 1. In a similar manner, the flanges 51 and 56 along the inside edges of the metal web member, as shown in FIG. 3 is continuous with a central section 55. This central section of the flange 55 abuts the bottom edge of the top wooden member such as member 2 in FIG. 1. In this manner the spacing between the two wooden members and the relationship with the metal web members can be easily and properly maintained.

The teeth of the metal web members, such as teeth 34 and 36, are embedded into the wood. As shown in FIG. 6 the teeth of the two web members 16 and 60 are embedded in wooden member 58. As also shown by such figure the wooden member 58 rests upon central inner flange sections 55 and 57 for proper positioning of the wooden member.

In a modified embodiment of the metal web member 80 instead of each leg having a single groove, each leg can be provided with two separate grooves. Thus as illustrated in FIG. 7, leg 82 has two separate grooves 86 and 88 and similarly leg 84 has two separate grooves 90 and 92. Since the grooves are only formed at the two ends of each of the legs, the material available for the flanges in the central portion of the leg is significantly greater. By maintaining the width of each of the legs substantially constant throughout its length, the material not taken up by the omission of the groove in the central portion of the leg can be used for increasing the depth of the flanges. Consequently the depth of the flanges of each of the legs is significantly deeper at the central section than at its ends similar to the flanges of the web member illustrated in FIG. 3 except to a greater extent.

The overall size of the metal web member would depend upon the depth of the particular truss member being formed. For example, two typical depths for joist members are the construction of 12 inch and 16 inch joists. In constructing a 12 inch deep joist member the height of the metal web member would be approximately $11\frac{1}{4}$ inches. In accordance with a preferred embodiment the overall length of the metal web member from the outer extremity of one of the connector plates at the end of one of the legs to the connector plate at the end of the other leg would be slightly less than 24 inches. The connector plate at the extremity of each leg of the metal web member would have a width of approximately $3\frac{3}{4}$ inches and a height of approximately $1\frac{1}{2}$ inches. The connector plate at the apex of the metal web member would have a height of $1\frac{1}{2}$ inches and a width of approximately 6 inches. The width of each of the legs would be approximately $1\frac{1}{4}$ inches and the depth of each of the flanges would be approximately 19/32 inches with such depth varying between the center and the ends by approximately 1/16 inches. Located within each of the legs at a location adjacent the connector plates at the extremities can be small holes for use in arranging the metal web members on a truss forming machine for pressing the metal web members into the wooden members. The metal web member typically would be made of 20 gauge steel although this could vary depending upon the compressive loads to which the metal web member was to be subjected.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A metal web member for interconnecting elongated wooden members, said metal web member having a V-shaped metal web member comprising: connector plates located at the apex and at each of the extremities of said V-shaped metal member, each connector plate having struck out therefrom a plurality of teeth, all of said teeth extending from the same face of said metal web member; a leg member connected between each of said connector plates at each of said extremities and said apex, each of said legs having at least one groove formed therein, said groove extending from the same side of said metal web member as said teeth so that said teeth can be pressed into corresponding wooden members by a roller rolling over said web member and each of said legs having side flanges extending on both sides thereof for the entire length of said leg and extending in the same direction as said groove; the depth of each said groove varies along its length with said groove being larger in its cross-section at its ends than at its center and the depth of each said flange varies along its length with said flange being deeper at its center than at its ends; and, said flanges and said groove of each leg being formed with appropriate depths to sufficiently increase the rigidity of said metal web member for avoiding bending of said leg when subjected to normal compressive loads.

2. A metal web member according to claim 1 wherein the depth of each of said flanges is at least approximately $\frac{1}{3}$ of the width of the corresponding said leg in order to increase the strength of said leg so as to cause said leg to be more resistant to forces that tend to bend said leg.

3. A metal web member according to claim 2 wherein the width of said leg is approximately $1\frac{1}{4}$ inches and the minimum depth of each of said flanges is approximately $\frac{1}{2}$ inch and the variance in the depth of each of said flanges is approximately 1/16 inch.

4. A metal web member according to claim 1 wherein each of said flanges is curved outwardly so that the cross-sectional configuration of each of said legs is in the form of a partial tube.

5. A metal web member according to claim 1 wherein the width of said connector plate located at said apex of said metal web member, measured at its widest portion, is slightly less than twice the width of each of said connector plates at said extremities of said metal web member measured at its widest portion.

6. A metal web member according to claim 5 wherein said width of said connector plate at said apex is approximately 6 inches and said width of each of said connector plates at said extremities is approximately $3\frac{3}{4}$ inches.

7. A metal web member according to claim 1 wherein said web member is symmetrical about a center line through said metal web member with all of the pairs of said teeth being on one side or the other of said center line.

8. A metal web member according to claim 7 wherein said connector plate at said apex has at least six columns of teeth with the outer three columns on each side of said center line extending in a slanted direction in the same direction of the corresponding said leg and all of said pairs of teeth in each of said columns being substantially aligned.

9. A wooden truss assembly comprising two elongated wooden members spaced apart and a plurality of V-shaped metal web members interconnecting said elongated wooden members, each of said metal web members including: connector plates located at the apex and at each of the extremities of said V-shaped metal member, each connector plate having struck out therefrom a plurality of teeth, all of said teeth extending from the same face of said metal web member; a leg member connected between each of said connector plates at each of said extremities and said apex, each of said legs having at least one groove formed therein, said groove extending from the same side of said metal web member as said teeth and each of said legs having side flanges extending on both sides thereof for the entire length of said leg and extending in the same direction as said groove; the depth of each said groove varies along its length with said groove being deeper at its ends than at its center and the depth of each said flange varies along its length with said flange being deeper at its center than at its ends; and, said flanges and said grooves being formed with an appropriate depth to sufficiently increase the rigidity of said metal web member for avoiding bending of said leg when subjected to normal compressive loads.

10. A wooden truss assembly according to claim 9 wherein the depth of each of said flanges is approximately $\frac{1}{3}$ of the width of the corresponding said leg.

11. A wooden truss assembly according to claim 9 or 10 wherein each of said flanges is curved outwardly so that the cross-sectional configuration of each of said legs is in the form of a partial tube.

12. A wooden truss assembly according to claim 9 or 10 wherein the width of said connector plate located at said apex of said metal web member measured at its widest portion is slightly less than twice the width of each of said connector plates at said extremities of said metal web member measured at its widest portion.

13. A metal web member having a V-shaped formation and being formed from a sheet metal plate, said metal web member comprising: connector plates located at the apex and at each of the extremities of said V-shaped metal member, each connector plate having struck out therefrom a plurality of teeth, said teeth extending from the same face of said metal web member; a leg member connected between each of said connector plates at each of said extremities and said apex, each of said legs having at least one groove formed therein, said groove extending from the same side of said metal web member as said teeth and each of said legs having side flanges extending on both sides thereof for the entire length of said leg and extending in the same direction as said groove; said flanges and said groove of each leg being formed with appropriate depths to sufficiently increase the rigidity of said metal web member for avoiding any bending of said leg when subjected to normal compressive loads; and the depth of each said groove varies throughout its length with said groove being larger in its cross-section at its ends than at its center and the depth of each said flange varies throughout its length with said flange being deeper at its center than at its ends.

14. A metal web member according to claim 13 wherein the depth of each of said flanges is at least approximately $\frac{1}{3}$ of the width of the corresponding said leg.

15. A metal web member according to claim 14 wherein the width of said leg is approximately $1\frac{1}{4}$ inches and the minimum depth of each of said flanges is approximately 19/32 inch and the variance in the depth of each of said flanges is approximately 1/16 inch.

16. A metal web member according to claim 13 wherein each of said flanges is curved outwardly so that the cross-sectional configuration of each of said legs is in the form of a partial tube.

17. A metal web member according to claim 13 wherein the width of said connector plate located at said apex of said metal web member measured at its widest portion is slightly less than twice the width of each of said connector plates at said extremities of said metal web member measured at its widest portion.

18. A metal web member according to claim 17 wherein said width of said connector plate at said apex is approximately 6 inches long and said width of each of said connector plates at said extremities is approximately $3\frac{3}{4}$ inches.

* * * * *